United States Patent [19]

Clark

[11] Patent Number: 4,707,156

[45] Date of Patent: Nov. 17, 1987

[54] PRINTER STAND AND PAPER REFOLDING APPARATUS

[75] Inventor: James B. Clark, Oakdale, Calif.

[73] Assignee: MicroComputer Accessories Inc., Los Angeles, Calif.

[21] Appl. No.: 782,280

[22] Filed: Sep. 30, 1985

Related U.S. Application Data

[63] Continuation-in-part of Ser. No. 613,521, May 24, 1984, abandoned.

[51] Int. Cl.[4] ..... B41J 11/58

[52] U.S. Cl. ..... 400/613.2; 400/691; 400/694; 312/208; 248/676

[58] Field of Search ..... 400/613, 613.1, 613.2, 400/613.3, 613.4, 619, 642, 691, 694; 312/39, 40, 41, 91, 194, 195, 196, 197, 208, 183; 248/127, 637, 152, 174, 176, 441, 442.2, 676; 226/200; 270/1.1, 39, 40; 493/409, 410, 411, 413, 416, 455, 460, 461, 477; 211/13, 42, 45, 50

[56] References Cited

U.S. PATENT DOCUMENTS

| | | | |
|---|---|---|---|
| 1,358,033 | 11/1920 | Smith | 312/208 X |
| 1,656,153 | 1/1928 | Smith | 400/613.2 X |
| 2,018,052 | 10/1935 | Caton | 400/613.2 |
| 2,077,428 | 4/1937 | Mabon | 400/613.2 X |
| 2,219,762 | 10/1940 | Burdick et al. | 312/208 X |
| 2,300,984 | 11/1942 | Smith | 312/40 |
| 2,369,441 | 2/1945 | Daly et al. | 400/613.2 X |
| 2,517,510 | 8/1950 | Singer | 400/613.2 X |
| 2,806,576 | 9/1957 | Buckley, Jr. | 400/613.2 X |
| 2,845,019 | 7/1958 | Stiefel | 400/613.2 X |
| 2,906,527 | 9/1959 | Blain | 400/613.2 X |
| 3,013,646 | 12/1961 | Sargent | 400/613.2 |
| 3,232,407 | 2/1966 | Drescher | 400/613.2 |
| 3,712,607 | 1/1973 | Ziegler et al. | 270/39 X |
| 3,939,955 | 2/1976 | Menzi | 400/613.2 X |
| 3,995,547 | 12/1976 | Shimodaira et al. | 400/619 X |
| 4,030,720 | 6/1977 | Jones | 493/413 X |
| 4,054,235 | 10/1977 | Witcher | 493/41 |
| 4,175,841 | 11/1979 | LaPorte | 400/613.2 X |
| 4,226,410 | 10/1980 | McIntosh, Sr. et al. | 400/613.2 X |
| 4,313,112 | 1/1982 | Foster | 312/196 |
| 4,345,803 | 8/1982 | Heck | 312/208 X |
| 4,408,916 | 10/1983 | Burgert | 400/613.2 |
| 4,431,238 | 2/1984 | Evans | 400/613.2 X |
| 4,515,490 | 5/1985 | Marker, III | 400/613.2 |
| 4,522,521 | 6/1985 | Scott | 400/613.2 X |
| 4,541,749 | 9/1985 | McCoy | 400/613.2 |
| 4,544,065 | 10/1985 | Mueller | 211/13 |
| 4,563,102 | 1/1986 | Sanders, Jr. et al. | 400/613.2 X |
| 4,570,802 | 2/1986 | Murphy | 211/13 |

FOREIGN PATENT DOCUMENTS

| | | | |
|---|---|---|---|
| 0043008 | 1/1982 | European Pat. Off. | 400/613.2 |
| 2549165 | 5/1977 | Fed. Rep. of Germany | 400/613.2 |
| 0060282 | 5/1981 | Japan | 400/613.2 |
| 0011072 | 1/1982 | Japan | 400/613.2 |
| 0075881 | 5/1982 | Japan | 400/613.2 |
| 0087384 | 5/1982 | Japan | 400/613.2 |
| 0173184 | 10/1982 | Japan | 400/613.2 |

OTHER PUBLICATIONS

IBM Technical Disclosure Bulletin, "Forms Stacking Aid", Ryan et al, vol. 20, No. 1, Jun. 1977, p. 97.

IBM Technical Disclosure Bulletin, "Display Detachable Printer Stand", Gilvey et al., vol. 27, No. 1A, Jun. 1984, p. 39.

IBM Technical Disclosure Bulletin, "Fan-Fold Paper Rack", David, vol. 4, No. 1, Jun. 1961, p. 1.

*Primary Examiner*—Ernest T. Wright, Jr.

*Attorney, Agent, or Firm*—Robert S. Smith

[57] ABSTRACT

A combination printer stand and paper refolding apparatus for use with an associated printer and associated fanfold paper which includes, in one form, a printer receiving shelf dimensioned and configured for holding a printer, and a paper receiving shelf dimensioned and configured for receiving paper on which printing has been completed. The paper receiving shelf is disposed substantially beneath the printer receiving shelf and the second paper receiving shelf is formed from a plurality of wire members. The printer stand includes other apparatus for directing the path of the associated fanfold paper leaving the associated printer to the paper receiving shelf and to cause refolding of the associated paper on the paper receiving shelf. The paper receiving shelf has an elongated peak intermediate the boundaries of the shelf. The apparatus for directing the path of the associated fanfold paper may include a pivotable mounted member. An anti-sag shelf may be included to direct the paper. The anti-sag shelf is generally planar and which is disposed in closely spaced, substantially parallel relationship to the underside of the printer receiving shelf.

7 Claims, 12 Drawing Figures

PRINTER STAND AND PAPER REFOLDING APPARATUS

PRIOR APPLICATIONS

This application is a continuation-in-part of application Ser. No. 613,521 filed May 24, 1984 by the same inventor, and now abandoned.

BACKGROUND OF THE INVENTION

The invention relates to printer stands and particularly to printer stands which automatically collect and refold fanfold paper, such as that typically used for business forms, as well as other printing.

The advent of personal computers has produced a demand for better paper handling apparatus and particularly for apparatus which duplicates apparatus used in large commercial job sites. A major difference is the space limitations inherent in the usual personal computer work place. The relatively confined work places available for most personal computers dictates new approaches.

The prior art includes apparatus such as that shown in the following U.S. Pat. Nos. 2,018,052; 2,806,576; 2,845,019; 3,232,407; and 3,939,955.

The art of refolding continuous forms as they pass out of a printing device has been known for many years. The known apparatus may be generally categorized as follows: (1) Desk Top Printer Stands.

There are inexpensive "benches" which raise the printer above table level and provide an area under the "bench" for the storing of the paper supply. No consideration has been given to the very real problems of what happens to the printed forms from the printer. This results in (a) the stand having to be located a substantial distance from any rear wall surface and thus, there is no real chance that the printed forms will refold neatly behind the printer, or (b) the printed forms descend to the rear in a disorderly fashion and are finally retrieved from the floor level beneath, or (c) the printed forms stack in a very disorderly fashion against the rear wall surface, or (d) a receiving basket (usually wire formed, see below) accessory is added which mandates that substantial space be provided for its location behind the printer. (2) Receiving Baskets.

These are usually wire formed. They are usually designed to be secured at the rear of the surface upon which the printer is located. Often they are an accessory to a floor standing printer stand. (see below). They have (a) no provision for paper supply, (b) substantial space must be provided to the rear of the surface on which the printer is located, and (c) retrieval of the printed forms is often very inconvenient for the operator. (3) Floor Standing Printer Stands.

These stands have two major disadvantages when compared to the apparatus of the present invention: (a) floor space consumption, and (b) cost.

It is an object of the invention to provide apparatus which will both hold the printer and refolded paper on which printing has already been completed and which will be compact enough to be used on top of a desk or table.

It is another object of the invention to provide apparatus which will refold the paper upon which the printing has been completed almost directly under a shelf provided to hold the printer.

Still another object of the invention is to provide apparatus which is reliable.

Another object of the invention to provide apparatus which will function with a wide variety of printers.

Yet another object is to provide, at least in some embodiments of the invention, a place for storage of unprinted paper within the stand.

It is another object of the invention to provide apparatus which is inexpensive to manufacture, in part, because less materials are required because of the compactness of the apparatus.

SUMMARY OF THE INVENTION

The foregoing objects and other objects and advantages which shall become apparent from the detailed description of the preferred embodiment are attained in a combination printer stand and paper refolding apparatus for use with an associated printer and associated fanfold paper which, in one form, includes a printer receiving shelf dimensioned and configured for holding a printer, and a paper receiving shelf dimensioned and configured for receiving paper on which printing has been completed. The paper receiving shelf is disposed substantially beneath the printer receiving shelf, the paper receiving shelf is formed from a plurality of wire members, and the apparatus also includes means for directing the path of the associated fanfold paper leaving the associated printer to the paper receiving shelf and to cause refolding of the associated paper on the paper receiving shelf.

In some forms of the invention the paper receiving shelf is elongated and the paper receiving shelf has a peak intermediate the boundaries thereof. The peak may be elongated, may extend parallel to a substantially rectilinear side of the paper receiving shelf and may extend intermediate two opposed sides of the paper receiving shelf and be spaced from the two opposed sides.

Other forms of the invention include a printer receiving shelf dimensioned and configured for holding a printer, a paper receiving shelf dimensioned and configured for receiving paper on which printing has been completed disposed substantially beneath the printer receiving shelf, and means for directing the path of the associated fanfold paper leaving the associated printer to the paper receiving shelf and to cause refolding of the associated paper on the paper receiving shelf. The means for directing the associated fanfold paper includes a pivotally mounted member.

In these forms of the invention the pivotally mounted member may be generally planar and may be elongated and be pivotally mounted with a pivot axis extending generally parallel to fold lines of the associated fanfold paper. The pivotally mounted member may include a knob for manual adjustment. The apparatus may include means to prevent the sag of paper passing under the printer receiving shelf and the means to prevent the sag of paper includes an anti-sag shelf which is generally planar and which is disposed in closely spaced, substantially parallal relationship to the underside of the printer receiving shelf. The printer receiving shelf may be manufactured of plastic and have a plurality of depending ribs disposed intermediate the bottom of the printer receiving shelf and the anti-sag shelf.

The second printer receiving shelf may have the upper extremity thereof formed in the general contour of a cylindrical section to thereby route paper to the paper receiving shelf and the second paper receiving shelf may have an opening therein for cooperation with associated bottom input paper feed printers.

In still other forms of the invention the apparatus includes a printer receiving shelf dimensioned and configured for holding a printer and a paper receiving shelf dimensioned and configured for receiving paper on which printing has been completed. The paper receiving shelf is disposed substantially beneath the printer receiving shelf and a paper receiving shelf dimensioned and configured for receiving paper on which printing is to be accomplished, the paper receiving shelf is disposed substantially beneath the printer receiving shelf and the apparatus includes means for directing the path of the associated fanfold paper leaving the associated printer to the paper receiving shelf and to cause refolding of the associated paper on the paper receiving shelf.

In most forms of the invention the apparatus has a height which is less than the front to back width of the apparatus.

The forms of the invention having a paper receiving shelf for paper on which printing is to be accomplished may include means to tip the stack of paper thereon in the direction in which the paper is removed from the stack.

BRIEF DESCRIPTION OF THE ACCOMPANYING DRAWING

The invention will be better understood by reference to the accompanying drawing in which.

DESCRIPTION OF THE PREFERRED EMBODIMENT

Figure 2:
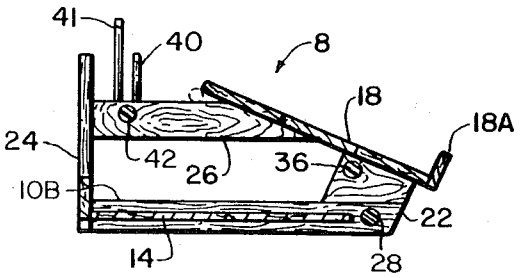
FIG. 2 is a sectional view taken along the line 2—2 of FIG. 1.
Figure 3:
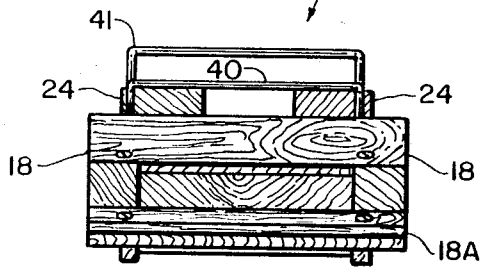
FIG. 3 is a front elevational view of the apparatus of FIG. 1.
Figure 1:
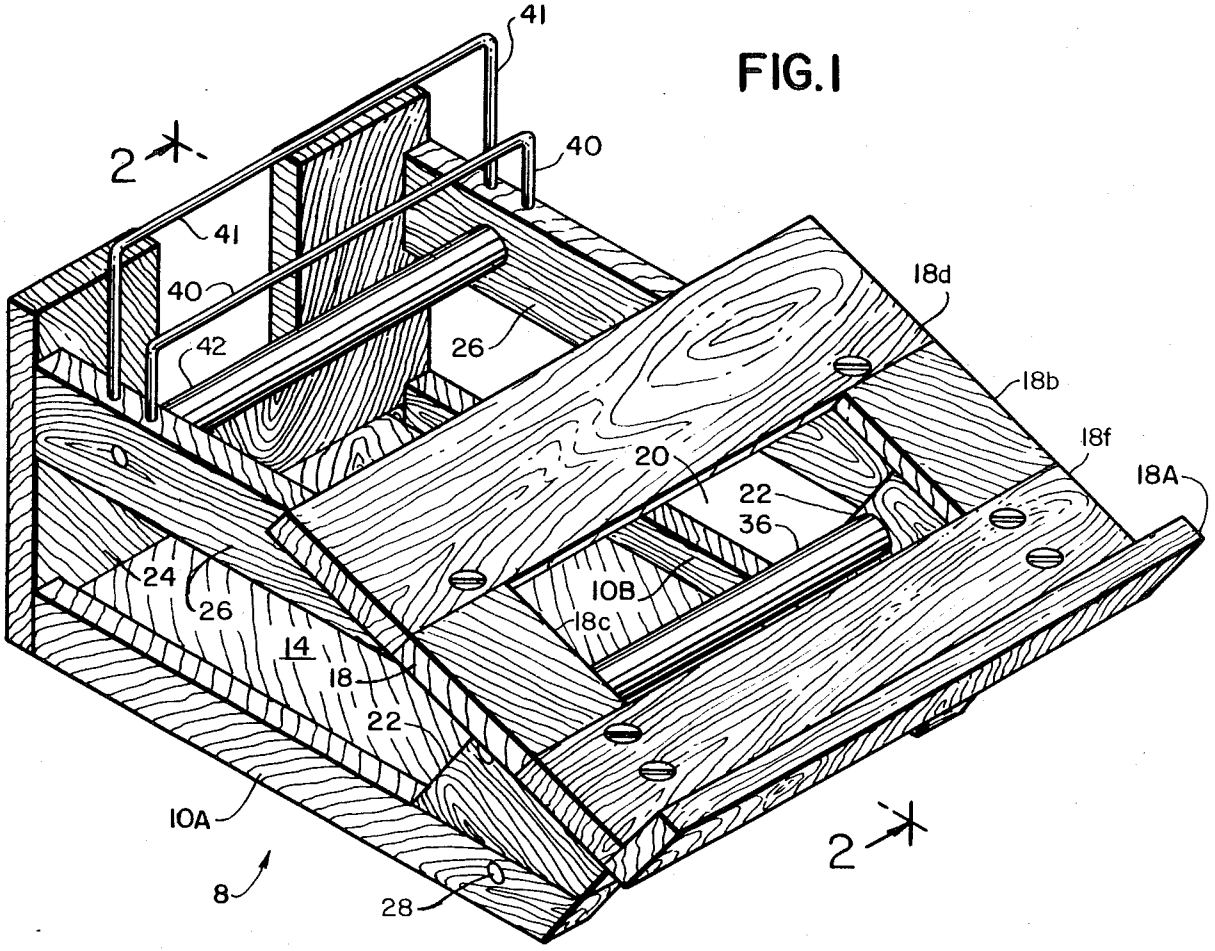
FIG. 1 is a perspective view of the apparatus in accordance with a first form of the invention.
Figure 4:
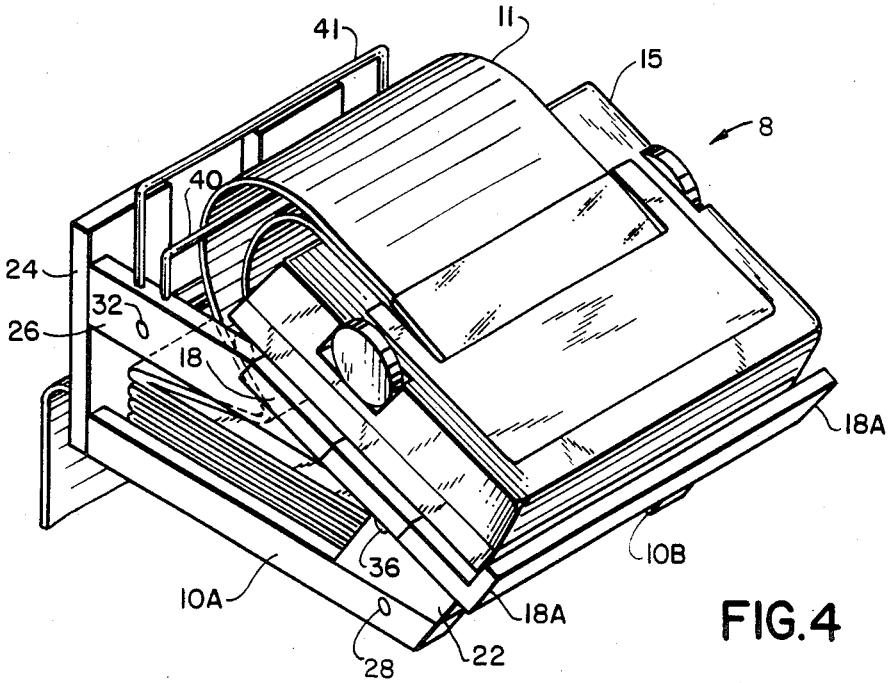
FIG. 4 is a perspective view of apparatus similar to that of FIGS. 1–3, showing the movement of paper when fed to the printer from the rear.

Referring now to FIGS. 7–12 there is shown an embodiment of the stand in accordance of the invention. This stand 80 includes spaced side members 82, 84. Ordinarily these members 82, 84 will be manufactured of plastic and will have a smooth exterior surface. Extending between the side members or panels 82, 84 is a top tray or printer receiving shelf 86. The printer receiving shelf 86 is provided with an opening 88 which is dimensioned to allow bottom feed of paper to printer 101 such as the Okidata printer (marketed in the United States by Okidata Corporation, Mt. Laurel, N.J. The opening 88 is also dimensioned to function with other bottom feed printers. Disposed in closely spaced relation to the printer receiving shelf 86 is an anti sag shelf 90. The printer receiving shelf 86 is provided with a plurality of depending ribs 92 (one shown in FIG. 10) which are parallel and spaced apart. The function of the anti sag shelf 90 as will be described hereafter is to prevent sagging of the paper being fed. Such sagging would interfere with the refolding which occurs on the refold tray 94 to be described hereafter.

Figure 11:
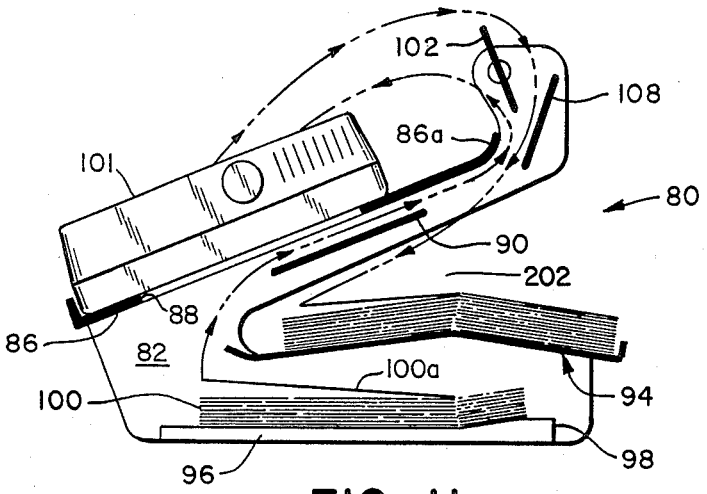
FIG. 11 is a schematic elevational view illustrating the paper path in the embodiment of FIGS. 7–10.

Also extending between the side panels 82,84 is an input paper receiving shelf or bottom tray 96 which, like the printer receiving shelf 86 is generally planar. However, unlike the printer receiving shelf 86 the bottom tray 96 is provided with a plurality of ribs 98, sometimes referred to as pick-up assist ribs. The function of these ribs 98 is to position the stack of unprinted paper 100, as best seen in FIG. 11, to minimize the force required to pull the unprinted paper off the stack 100 and thus to start that paper on it's path towards the printer 101.

Also extending between the side members 82,84 is a pivotally mounted member or pivoting deflector 102. The pivoting deflector 102, in the preferred embodiment is generally planar with end caps 104 that engage the extremities thereof. The end caps 104 are pivotally carried by the side members 82,84. A knob 106 engages one of the end caps 104 so that a user may manually, position the angular orientation of the pivoting deflector 102 for optimum separation of the paper going into the printer 101 and the paper going out of the printer 101.

A rear deflector 108 also extends between the side panels 82,84. The rear deflector 108 is disposed proximate to the pivoting deflector 102 and the upper most extremity 86*a* of the printer receiving shelf 86. The upper most extremity 86*a* of the printer receiving shelf 86 is curved and is a cylindrical section. The purpose of this extremity 86*a* is to direct the paper from the bottom tray 96. Referring to FIG. 11 the path defined by the paper leaving the stack 100 will be seen to be deflected by the extremity 86*a*.

Figure 9:
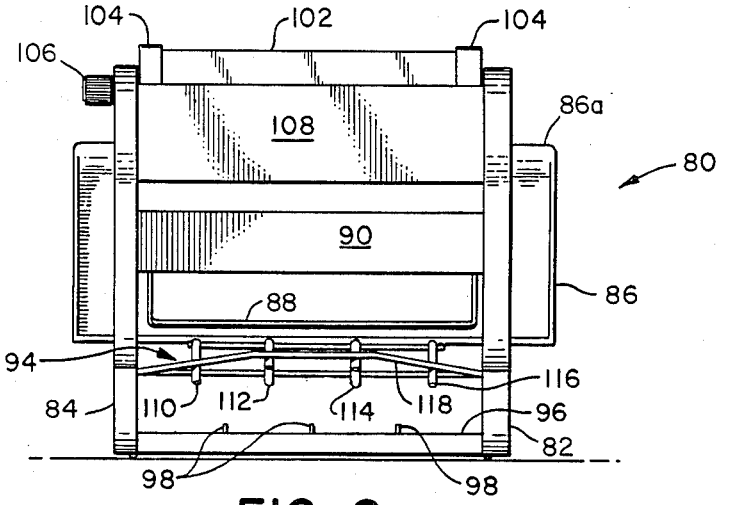
Figure 10:
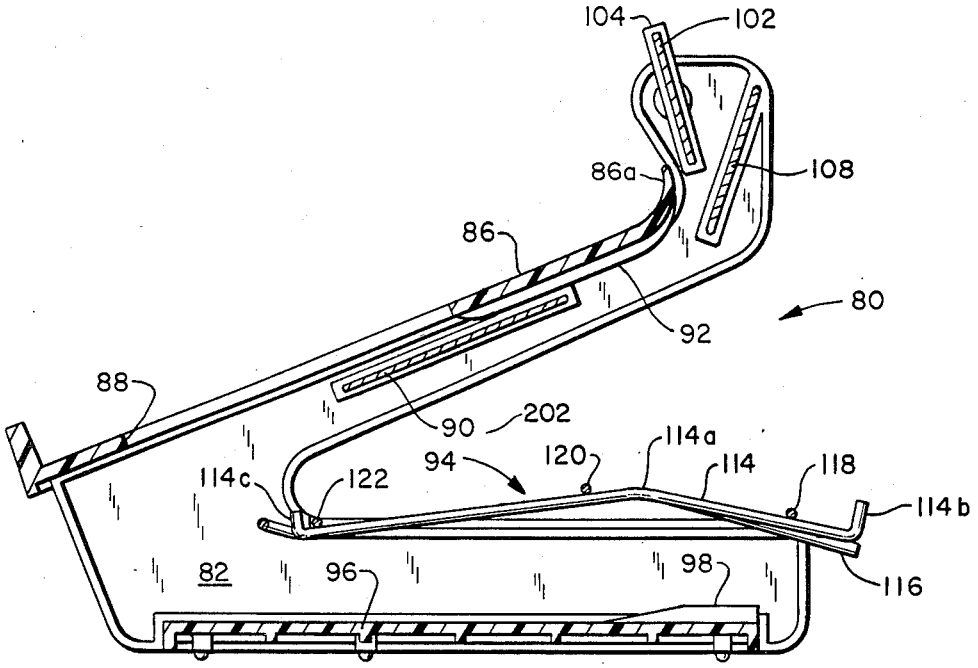
FIG. 10 is a sectional view taken along the line 10—10 of FIG. 8.
Figure 12:
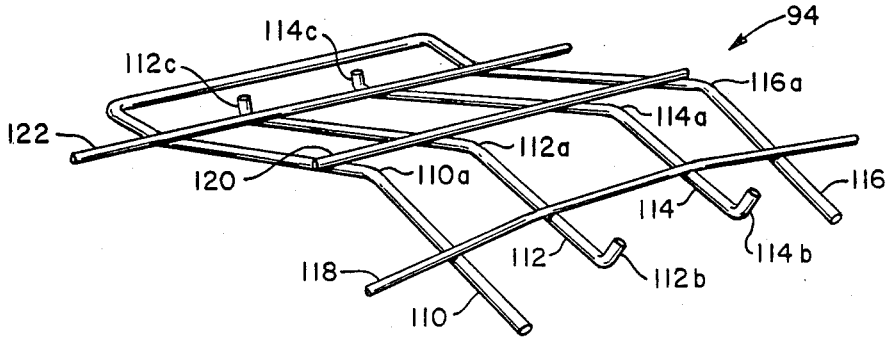
FIG. 12 is a perspective view of the refolding paper tray shown in FIGS. 7–10.

Carried on the side members 82, 84 is the refolding paper tray 94. The refolding paper tray 94 is manufactured, in the preferred embodiment, of steel wires 110, 112, 114, 116 which have a peak or hump shape. As best seen in FIGS. 10–12 the peak or hump is nearer to the rearmost (as viewed in the drawing) extremity of the refolding paper tray 94. As will be seen in FIGS. 9 and 12 the peak extends laterally across the tray 94 at a location closer to the extreme rear of the tray 94 than to the front of the tray 94. The peak or hump is defined by respective bends or knees 110*a*, 112*a*, 114*a*, and 116*a* which are disposed in the longitudinally extending wires 110, 112, 114, and 116. More specifically, the rearmost portion of the refolding paper tray 94 tapers downwardly to the sides as best seen in FIG. 9. As will be seen in FIG. 7 the wires 110 and 116 which extend in a direction which is generally parallel to the side panels 82, 84 and are nearest to the side panels 82, 84 are lower at the rear section of the tray 94 than the wires 112 and 114 which are generally parallel to the side panels 82 84 and which are nearer to the geometric center of the tray 94. Accordingly, a cross member 118 that extends across the rear of the wires 110,112, 114, and 116 bends downwardly at the wires 112, 114 to join with the wires 110, 116. This is clearly shown in FIG. 9. The cross members 120, 122 are rectilinear and disposed in generally parallel relation to the cross member 118.

As will be most apparent from FIG. 12 the wires 110 and 116 are axial extremities of a single U-shaped wire member. The centrally disposed wires 112, 114 are provided with L-shaped bends 112*b*, 114*b*, 112*c*, 114*c* at the axial extremities thereof as best seen in FIGS. 10 and 12.

The apparatus in accordance with the invention has been constructed with the following design considerations: (1) Width.

A printer is, of course, always physically wider than the width of the paper it is designed to process. With this in mind, the stand 80 has been designed in a unique cantilever fashion. Thus, the footprint of the apparatus is substantially less than the printer itself. (2) Depth.

Since the paper is refolded substantially beneath the printer, and since the printer is oriented at a slant, the net depth of the stand 80 is significantly less than would otherwise be required for a printer, its paper supply, and space provision for receiving the printed forms. (3) Height.

One of the most important design considerations was to accomplish all the functional objectives in a vertical height measurement which would still allow the stand 80 to be placed conveniently at desk top level and allow convenient operator viewing of the line being currently printed.

The vertical stacking of the paper supply, the refolded paper, and the printer, one upon the other within the above constraints successfully, and with refolding of the printed output is a major advantage of the apparatus of the invention.

Paper management considerations in constructing the stand 80 include paper refolding control, paper sources, and paper capacities. The shape of the paper path, as illustrated in FIG. 11, creates a pie shaped open area for the refold function. The pivoting deflector 102 in the embodiment of FIGS. 7–12 accomplishes two important functions: 1. separate the input forms or paper from the current output forms or paper to thus prevent friction between the two which would defeat the refold process and 2. provide an adjustable bridge to carry the output form to the refold system. Adjustment is necessary to compensate for the differences between printers for the level and characteristics of their output function.

The pivoting deflector 102 sets up the forward refold of the printed form. Because of the small vertical height of the apparatus in accordance with the invention it is not possible to effectively use the weight of the paper and gravity to assist in causing refolding as in some prior art apparatus.

The anti-sag shelf 90 prevents the input paper from sagging down in such a way as to physically conflict with the forward refolding of the output form. The elimination of the anti-sag shelf 90 would seriously compromise system operation.

The peaked shape of the wire formed refold tray 94 allows the pick up of the supply paper to be performed with a minimum of friction and restraint. More specifically, the fanfold paper being drawn from the stack 100 will tend to touch the underside of the refold tray 94. With the paper supply at the maximum recommended volume the maximum restraint is experienced. Referring to FIG. 11, it will be understood that the movement of the top sheet 100*a* in the stack 100 (shown just lifting off the stack 100) will result in the rise of the right most (as viewed) extremity of the top sheet 100*a* until it strikes the refold tray 94. Thus the design of the tray 94 assures that the point of contact of paper and tray 94 is to the rear of the peak defined by the bends 110*a*, 112*a*, 114*a* and 116*a*. As the paper is drawn forward there is contact of the rearmost fold of the top sheet 100*a* against the bottom of the refold tray 94, in an area where the bottom surface of the tray 94 slopes upward.

This unique and important shape together with a polished bottom surface of the wires 110, 112, 114, 116, of the tray 94 allows the stand 80 to provide the maximum amount (approximately 500 sheets of 15#paper) of paper supply. Extensive testing has shown that the peak point is at the critical location to perform the above. This feature contributes importantly to providing a very small overall unit height. Without it, it would be necessary to increase the height in order to provide the desired supply paper capacity.

The pick up assist ribbing 98 is an important design feature to further overcome resistance and friction. It must be kept in mind that the major objective is to provide a functionally operative printer stand with desirable dimensions. It can be easily demonstrated that the pick up assist ribbing 98 reduces the natural resistance to the pick up of the next supply sheet 100*a* from the stack 100 and particularly the back fold (the fold of the fanfold paper nearest the back of the stack 100.

A ramp formed in the preferred embodiment by pick up assist ribbing 98 substantially reduces the resistance to the very first upward movement of the back fold of the next supply sheet 100*a* as it passes into the paper path. This is accomplished by tipping the stack 100.

The stand 80 provides an on board supply of approximately 300 to 500 sheets (for future printing) depending upon the weight (thickness) of the stock used. An extensive market survey has shown that this capacity is adequate for most users. Providing this capacity, while still maintaining minimal overall unit height was in large part attributable to the shape of the refold tray 94 and the polished metal surfaces therein.

Figure 5:
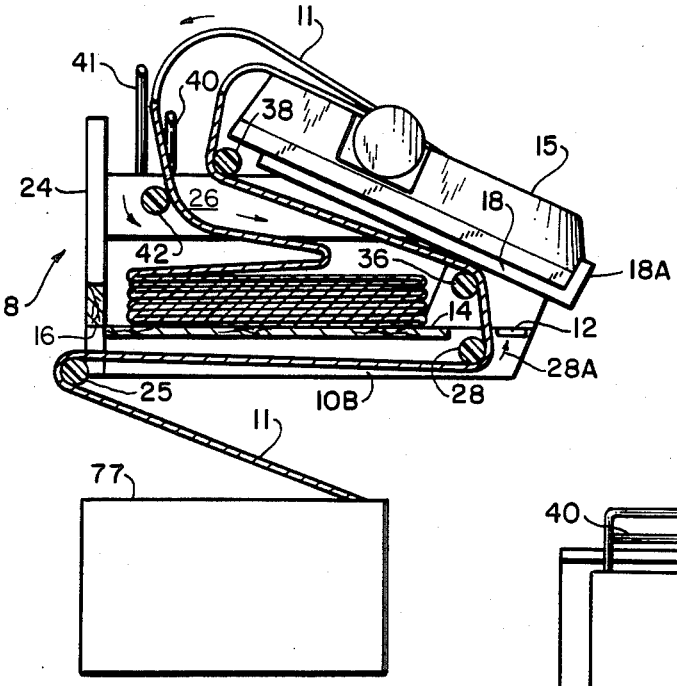
FIG. 5 is a schematic, elevational view further illustrating the movement of the paper for rear feed to the printer.
Figure 6:
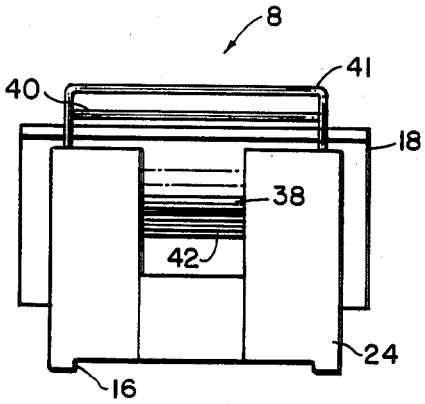
FIG. 6 is a rear elevational view of the apparatus of FIG. 1.
Figure 7:
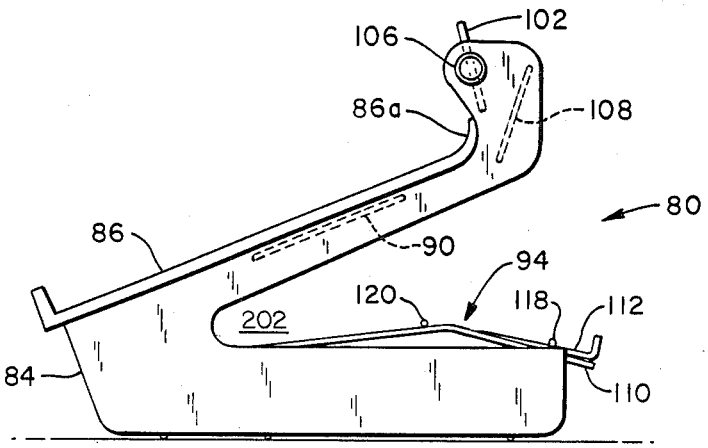
FIGS. 7, 8 and 9 are respectively side, front and rear elevational views of a second form of the apparatus in accordance of the present invention.
Figure 8:
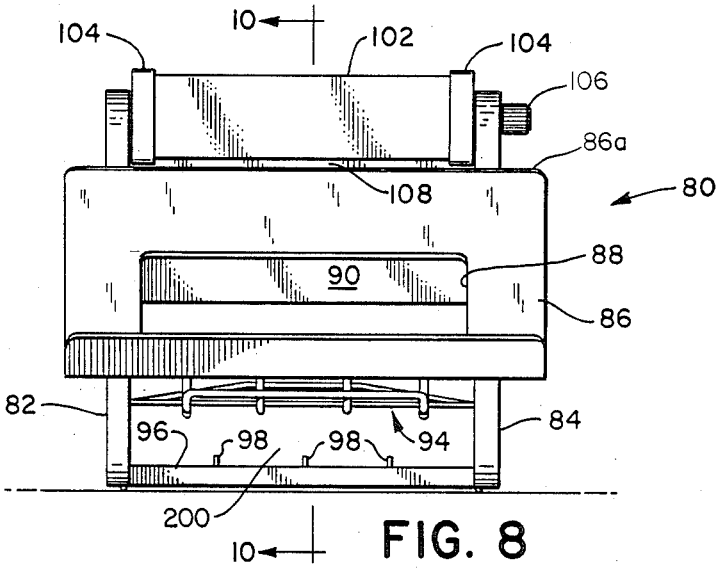

The user may alternatively elect to draw the paper supply from a box such as element 77 in FIG. 5 of preprinted forms or blank paper. The box 77 (or other stacked source) will be located in front of the stand 80. It may, for example, be located on the floor in front of the table surface on which the printer 101 is located. The fresh paper is then simply inserted through the open lower front of the stand 80 (below the printer receiving shelf 86), then to the printer 101, then to the pivoting deflector 102, and then to the refold tray 94.

This design feature is important for the user who employs several styles of paper and/or forms. The user might elect, for example, to use the On Board Storage area for the supply of blank computer paper. When the time or need arises for the use of such forms as payroll checks, invoices, accounts payable checks, etc., they may be front loaded without having to unload the bottom tray 96.

The stand 80 can refold approximately 80 to 150 sheets depending upon the weight (thickness) of the paper used. Extensive market research has shown this capacity to be sufficient for most users. Attaining this refolding capacity on the tray 94 is largely attributable to the anti-sag shelf 90.

The wire formed refold tray 94 may be instantly removed from the unit and placed aside. This allows the user to achieve the refold of 600 to 700 sheets. The source of fresh paper for this type of processing would, of course, be from a boxed supply such as element 77 in FIG. 5 in front of the stand 80.

This is an important design feature for a business user who, for example, must produce 500 month end customer statements. The user simply removes the refold tray 94 and any on board paper supply and the unit instantly converts to high volume capacities.

Many printer designs do not make adequate provision for preventing an oftentimes serious conflict between cables and fresh paper being fed to the printer.

As will be noted in FIG. 10 the curved extremity 86*a* of the printer tray 86 provides the necessary separation of fresh paper supply and the wear of the printer. Surprisingly, most printer stands make little or no attempt to eliminate this source of serious difficulty. The apparatus of the present invention provides the required paper path and cable control with a single design feature.

One of the most common printer user complaints is lack of print line visibility. Most printers require the user to look down into the printer mechanism to read the current print line. This is inconvenient and uncomfortable.

The geometry of the stand 80 allows slanting the printer tray 86 downward an optimum angle to provide a major improvement in print line visibility. This has been accomplished without seriously affecting refolding capacity. At the same time it has allowed the reduction of the profile dimensions of the stand 80, resulting in a more cosmetically pleasing unit.

The fresh paper supply is simply loaded through the front opening 200 of the stand 80. The front opening 200 is below the printer receiving shelf 86 and intermediate side members 82,84. The fresh paper supply rests on the bottom tray 96. The printed and refolded printed forms may be removed from either side opening 202 of the side panels 82 and 84.

These side openings are 202 intermediate the generally U-shaped side panels 82,84. Alternatively, access may be provided through the front opening 202. In unusual circumstances, the printed forms can be easily removed from the rear of the stand 80 as well.

Many computer users desire easy portability of their printer and printer paper. This is often the case with professional software/programmer/systems personnel. In addition, many businesses with multiple processors share printers from station to station. With this in mind, the unit was designed so that it could easily be transported intact. The printer 101, stand, and paper supply stack 100 can easily be carried as a single unit.

The nature of the paper flow in the embodiment of FIGS. 7–12 is most apparent in FIG. 11, which illustrates the movement of paper form the bottom tray 96, over the anti-sag shelf 90, around the extremity 86*a*, into the printer 101, out of the printer 101, around the pivoting deflector 102, across the rear deflector 108, and into the refold tray 94.

Referring now to FIGS. 1–6, there is shown a printer stand and refolding apparatus 8 in accordance with another form of the invention. The printer stand 8 includes a base, which comprises first and second generally parallel base members 10A, 10B. The first and second base members 10A and 10B are disposed in substantially parallel relationship and in the preferred embodiment are manufactured of wood, having the dimensions of approximately $1\frac{1}{2}$ by $\frac{3}{4}$ inches by $15\frac{5}{8}$ inches long. These base members 10A, 10B may be shaped to define a shoulder 12 on each member 10A, 10B. It is disposed in parallel relationship to the lowermost face of each base member 10A, 10B so that the uppermost face of the shoulders 12 is about $\frac{1}{2}$ inch from the surface on which the printer stand 8 rests. Alternatively, the shoulders 12 may be merely strips, which are glued to the base members 10A and 10B. Disposed on these shoulders 12, 12 is a shelf member 14, which is generally planar and in the preferred embodiment is a wooden sheet which is $\frac{1}{4}$ inch thick and measures approximately 11 by 12 inches.

Disposed in oblique relationship to the base members 10A, 10B and the paper receiving shelf 14 is a printer receiving shelf 18. In the preferred embodiment, the printer receiving shelf 18 is disposed at an angle of approximately twenty degrees with respect to the base members 10A, 10B and, hence, with respect to a table (not shown) on which the apparatus 8 is disposed. This printer receiving shelf 18 may be formed by four discrete coplanar wooden members 18*b*, 18i d, 18*e*, 18*f* or may be cut from plywood in the preferred embodiment. In one form of the invention the printer receiving shelf 18 measures about 16 by $12\frac{1}{2}$ inches, and has an opening 20 therein having dimensions which are 11 by $4\frac{1}{2}$ inches. (The opening 20 is provided to allow the feed of paper 11 to bottom feed printers.) The lowermost edge of the printer receiving shelf 18 is provided with a lip 18A to hold the printer 15 securely on the printer receiving shelf 18.

The angular relationshp between the paper receiving shelf 14 and the printer receiving shelf 18 results in a vertical space for fanfold paper 11 so that refolding can proceed without contact and friction with the printer receiving shelf 18. In the preferred embodiment brace members 22, 22 extend in substantially normal relation to the printer receiving shelf 18 from the base members 10A, 10B respectively. These brace members 22, 22 are manufactured of boards, which are $\frac{5}{8}$ by 4 inches. In the preferred embodiment the brace members 22, 22 are about 3 inches long.

Extending generally vertically is a U-shaped vertical support member 24, which may be cut from a single board or formed from several smaller pieces. The vertical support member 24 is approximately $\frac{3}{4}$ of an inch thick and has a maximum width of $12\frac{1}{2}$ inches and a maximum height of 9 inches. The vertical support member 24 is joined in the preferred embodiment to the rearmost ends of the base members 10A, 10B. The vertical support member 24 is provided with an arch shaped opening 16, best seen in FIG. 6, at the lowermost extremity thereof. The arch shaped opening 16 is approximately $10\frac{1}{2}$ inches wide and $\frac{1}{2}$ inch high. This arch shaped opening 16 allows for passage of the fanfold paper 11 from a supply at a lower elevation into the apparatus 8 and, thence, into a printer 15.

In order to facilitate the passage of the fanfold paper 11 from the supply underneath the table, particularly if the edge of the table has a very sharp right angle bend which is not in any way rounded, a tube or other cylindrical guide member 25 (shown in FIG. 5) may be fixed to the top surface of the table or to the rear of the apparatus 8 so that the fanfold paper 11 will rub on the cylindrical guide member 25 and thus move more freely than would be the case if the fanfold paper 11 rubbed along the edge of the table.

Extending intermediate the printer receiving shelf 18 and the vertical support member 24 are horizontal support members 26,26 which extend generally horizontally. The horizontal support members 26, 26 have a length of approximately $11\frac{1}{4}$ inches. The rearmost ends thereof abut and are perpendicular to the vertical support member 24. The other end of the horizontal support members 26, 26 in the preferred embodiment, are tapered axially to interface with the bottom of the printer receiving shelf 18.

The second or paper receiving shelf 14, which is 12 inches long in the preferred embodiment, extends 12 inches from the vertical support member 24. Similarly, the shoulder 12 on which the the paper receiving shelf 14 is carried extends substantially the same distance from the vertical support member 24. Disposed proximate to the front end (the end most remote from the vertical support member 24) of the paper receiving shelf 14 is a first cylindrical guide member 28. The first cylindrical guide member 28 may be either a stationary dowel shaped member or a rotatably mounted sleeve. An arrow 28A, shown in FIG. 5, indicates the direction of rotation in the rotatably mounted embodiment. Similarly, other arrows in FIG. 5 show the direction of paper movement as well as the direction of movement of other cylindrical guide members. In the preferred embodiment, the first cylindrical guide member 28 is disposed with the geometric center at substantially the same elevation as the paper receiving shelf 14. This cylindrical guide member 28 may be an axial section of polyvinyl chloride tubing having a diameter of $\frac{3}{4}$ of an inch. The geometric center of the first cylindrical guide member 28 is disposed approximately $\frac{3}{4}$ of an inch from the frontmost end of the shoulder 12 and the paper receiving shelf 14. The first cylindrical guide member 28 extends between the base members 10A, 10B. In one form the first cylindrical guide member 28 is merely an axial section of polyvinyl chloride tubing fixed to the base members 10A, 10B.

Extending respectively between the horizontal support members 26, 26 and the brace members 22,22 are second and third cylindrical guide members 36, 42, which are similar to the cylindrical guide member 28 and may also be either stationary, low coefficient of friction members such as polyvinyl chloride tubes or rods or, alternatively, a rotatively mounted sleeve, as described above. The second cylindrical guide member 36 is disposed substantially directly above the first cylindrical guide member 28. The third cylindrical guide member 42 is disposed between the horizontal support members 26, 26 to the rear of the printer receiving shelf 18 at an elevation which is in between the elevation of the highest edge of the printer receiving shelf 18 and the elevation of the second cylindrical guide member 36. An optional fourth guide member 38 or any equivalent extended shelf is provided to avoid interference with cables (not shown) which extend from the rear of some printers. In some cases, the printer receiving shelf 18 may merely extend a little higher and may be rounded to ensure that the fanfold paper 11 clears the cables as well as the entire housing of the printer 15.

Extending upwardly from the horizontal support members 26, 26 are two inverted U-shaped copper wires 40, 41. The shorter and lower of the two inverted U-shaped copper wires 40 is disposed approximately 2 7/8 inches from the vertical support member 24. The higher of the two inverted U-shaped copper wires 41 is disposed approximately 2 inches from the vertical support member 24. The two inverted U-shaped copper wires 40, 41 have a diameter of approximately 1/8 of an inch and together define a chute effective for directing the flow of paper 11. Disposed intermediate the horizontal support members 26, 26 is the previously referred to third cylindrical guide member 42, which may be either fixed and manufactured of a low coefficient of friction material such as polyvinyl chloride or a rotatively mounted roller as can all of the other guide members 25, 28, 36, 38. The third cylindrical guide member 42, disposed immediately below the inverted U-shaped wires 40, 41, is important to initiate the forward folding of the fanfold paper 11.

In operation, a box 77 of the fanfold paper 11 is positioned under the table (not shown). The fan fold paper 11 is inserted beneath the paper receiving shelf 14 and two or three extra sheets are slid through the opening space between the paper receiving shelf 14 and the top of the table (not shown) on which the apparatus 8 is disposed so that there is an ample supply to thread the paper 11 through the printer 15 and the apparatus 8 in accordance with the invention. The paper 11 is fed optionally over the first cylindrical guide member 25 through the arch shaped opening 16 in the vertical support member 24, under the paper receiving shelf 14 which is spaced from the top surface of the table by the shoulders 12, then fed around the second cylindrial guide member 28, the fourth cylindrical guide member 38, and thence, in the case of a bottom feed printer 15, through the printer 15 and then intermediate the copper wires 40, 41 which define a chute-like area, then round the third cylindrical guide member 42, and thence to a folded position on the paper receiving shelf 14.

The apparatus 8 will function properly even if the stack of folded paper 11 upon which printing has been completed is formed against the vertical support member 24, or even if it is positioned more directly under the printer 15 unless the paper 11 is very stiff. In that case it is best to position the stack of paper 11 abutting the vertical support member 24.

The higher of the two copper wires 41 is of particular importance after 100 or more sheets have accumulated on the paper receiving shelf 14. More particularly, the higher of the two copper wires 41 prevents overflow of paper 11 from the inside of the printer stand 8 into the area behind the printer stand 8. An additional U-shaped wire 40 may be required for many printers 15 where rear connections to the printer 15 will interface with the flow of the paper 11, particularly where it is necessary to feed the paper 11 into the printer 15 from the top or rear as opposed to a bottom feed printer 15.

Although, for relatively short print runs such as those utilizing 100 or less sheets, the location of the paper 11 stack on the paper receiving shelf 14 is not critical, it is advantageous for longer print runs to have the rearmost extremity of the paper 11 stack abut the vertical support member 24.

It is important to initiate folding on the paper receiving shelf 14 in a direction which is consistent with the original folds in the fanfold paper 11. In other words, just as a road map must be refolded in exactly the same way as it was originally folded in order to fold neatly, it is necessary to refold the fanfold paper 11 in exactly the same manner as it was previously folded.

Although one form of the invention has been described in terms of a wooden printer stand 8, it will be understood that the apparatus 8 may be manufactured of plastic or metal or other materials without departing from the spirit of the invention. The dimensions given herein are approximate and it will be understood that they will vary with different materials, different printer sizes, etc. In other embodiments of the invention the cylindrical paper guide members 28, 36, and 42 may be replaced by rounded edges on the printer receiving shelf 18 or on the paper receiving shelf 14. It will also be understood that although cylindrical members 25, 28, 36, 42 have been shown and described, other rounded laterally extending surfaces may be used. A chute-like passage is defined by the wires 40, 41 and the third cylindrical guide member 42.

Although specific dimensions have been mentioned herein, it will be understood that substantially different dimensions will be necessary when used with different size printers 15 and paper 11.

In most embodiments of the invention it will be understood that the vertial dimension of the apparatus 8 or 80 is less than the front to back width. This demonstrates how compact the assembly is and thus demonstrate how suitable it is for use on top of a table.

The invention has been described with reference to its illustrated preferred embodiments. Persons skilled in the art of constructing printer stands and paper refolding apparatus may, upon exposure to the teachings herein, conceive variations in the mechanical development of the components therein. Such variations are deemed to be encompassed by the disclosure, the invention being delimited only by the appended claims.

Having thus described my invention, I claim:

1. A combination printer stand and paper refolding apparatus for use with an associated printer, and associated sheets of fanfold paper, which comprises: a printer receiving shelf dimensioned and configured for holding a printer, said printer receiving shelf being disposed during normal operation in oblique relation to a horizontal plane; a first paper receiving shelf dimensioned and configured for receiving paper on which printing has been completed, said first paper receiving shelf being disposed substantially beneath said printer receiving shelf and being substantially horizontal during normal operation, said first paper receiving shelf having a peak intermediate the boundaries thereof, said peak being elongated and extending perpendicular to the direction of paper movement; and a second paper receiving shelf dimensioned and configured for receiving paper on which printing is to be accomplished, said second paper receiving shelf being disposed substantially beneath said first paper receiving shelf, said second paper receiving shelf having a minor portion thereof extending to the rear of said printer receiving shelf, said second paper receiving shelf being substantially horizontal during normal operation and including means for tipping a stack of the associated fan fold paper in the direction in which sheets of the associated fanfold paper are removed from said second paper receiving shelf; and means for directing the path of the associated fanfold paper leaving the associated printer to said second paper receiving shelf and to cause refolding of the associated fanfold paper on said second paper receiving shelf, said means for directing the associated fanfold paper including a pivotally mounted member which is elongated in a direction which is transverse to the direction of movement of the fanfold paper, said means for directing the associated sheets of fanfold paper directing the fanfold paper from the front of said first paper receiving shelf and to the back of said second paper receiving shelf after printing has been accomplished.

2. The apparatus as described in claim 1, wherein: said pivotally mounted member is generally planar.

3. The apparatus as described in claim 2, wherein: said pivotally mounted member is elongated and is pivotally mounted with a pivot axis extending generally transverse to said second paper receiving shelf.

4. The apparatus as described in claim 3, wherein: said pivotally mounted member includes a knob for manual adjustment.

5. The apparatus as described in claim 4, wherein: said apparatus includes means to prevent the sag of paper passing under said printer receiving shelf, said means to prevent the sag including an anti-sag shelf which is generally planar and which is disposed in closely spaced, substantially parallel relationship to the underside of said printer receiving shelf.

6. The apparatus as described in claim 5, wherein: said means for tipping comprises a plurality of upstanding ribs extending upwardly from said second paper receiving shelf, said plurality of ribs being substantially mutually parallel and tapered upwardly.

7. The apparatus as described in claim 6, wherein: said first paper receiving shelf comprises a plurality of wire members.

* * * * *